United States Patent [19]

Zimmerman

[11] Patent Number: 4,926,298

[45] Date of Patent: May 15, 1990

[54] CANDLE LAMP

[75] Inventor: Robert C. Zimmerman, Manlius, N.Y.

[73] Assignee: Hollowick, Inc., Manlius, N.Y.

[21] Appl. No.: 315,549

[22] Filed: Feb. 27, 1989

[51] Int. Cl.[5] ..... F21L 19/02; F21V 35/00

[52] U.S. Cl. ..... 362/163; 362/186; 362/314; 362/447; 431/291

[58] Field of Search ..... 362/161, 163, 186, 159, 362/174, 177, 182, 312, 313, 314, 441, 447; 431/291

[56] References Cited

U.S. PATENT DOCUMENTS

| | | | |
|---|---|---|---|
| 1,136,278 | 4/1915 | Schultz | 362/313 |
| 1,255,614 | 2/1918 | Krapp | 362/163 X |
| 4,224,017 | 9/1980 | Kayne | 431/291 |
| 4,260,365 | 4/1981 | Kayne | 362/163 X |

FOREIGN PATENT DOCUMENTS

| | | | |
|---|---|---|---|
| 190474 | 7/1957 | Austria | 362/163 |

*Primary Examiner*—Ira S. Lazarus
*Assistant Examiner*—Peggy Neils
*Attorney, Agent, or Firm*—Wall and Roehrig

[57] ABSTRACT

A table lamp having a pedestal and globe each with circular cross-sections has 12 vertical slots cut in the upper edge of the pedestal at 30 degree intervals and 3 inwardly projecting lugs on said globe arranged to engage in 3 of said slots with no more than 30 degrees rotation of the globe relative to the pedestal. The stability of the assembly is improved while retaining the simplicity of use of prior devices.

10 Claims, 1 Drawing Sheet

CANDLE LAMP

BACKGROUND OF THE INVENTION

This invention relates to a pedestal and globe for holding a candle or other illumination source to form a lamp of the type used on restaurant and night club tables and the like. In the restaurant business where lamps of this type are commonly used, they are subjected to frequent movement particularly by waitresses and bus boys who always are in a hurry and sometimes careless in handling glassware. Breakage caused by employees and customers is a significant problem. It is an annoying intrusion in a dining environment to have a heavy glass globe tumble off with accompanying noise, disruption, and embarrassment of diners and restaurant staff. Table lamps of this type should be of a rugged yet economical construction that is not easily tipped over, dislodged, damaged, or broken.

Typically, the upper edge of pedestals currently in use form a flat annular surface upon which the globe rests. Globes generally have three lugs formed on the inside thereof which rest on the top annular surface of the pedestal to support and locate the globe thereon.

This construction is economical to manufacture and provides a pleasing and attractive unit. The globe can be easily removed from the pedestal when the lamp is to be lighted and operates well when in place to sustain combustion. The assembly has, however, been found to be very unstable, and the globe is frequently dislodged from the pedestal and broken under ordinary handling conditions.

Patents found in the course of a preliminary search include U.S. Pat. Nos. 896,275; 2,080,251; 2,685,023; 2,749,733; 2,820,887; 2,842,658; and 3,558,871. Of these U.S. Pat. No. 2,080,251 to Buskard appears to applicant to be the most pertinent. Buskard shows the traditional three lugs resting on the top annular surface of the pedestal. Buskard also shows a complicated flange and grooved arrangement for securing the globe to the pedestal. This arrangement while being secure is very hard to use and promotes breakage of the lugs and consequently has not found wide commercial acceptance.

Applicant's invention, as described herein, provides almost as much security as Buskard's "notched flange and grooved lug" with the same ease of use as the non-secured types.

SUMMARY OF INVENTION

It is therefore an object of this invention to provide a lamp pedestal and globe combination that provides a stable and secure assembly.

It is another object of this invention to provide a lamp pedestal that will securely hold a globe assembled thereon.

It is a further object of this invention to provide a lamp pedestal that will securely receive and hold globes commonly available in the industry.

It is a still further object of this invention to provide a lamp pedestal and globe that will greatly reduce breakage of globes due to instability of the mounting of the globe on the pedestal.

Another object of the invention is to provide a lamp pedestal and globe assembly that can be knocked about without the danger of dislodging the globe from the pedestal during normal handling.

These and other and further objects of the invention will be apparent from the following description of a preferred embodiment shown in the accompanying drawings in which:

DESCRIPTION OF PREFERRED EMBODIMENT

Figure 1:
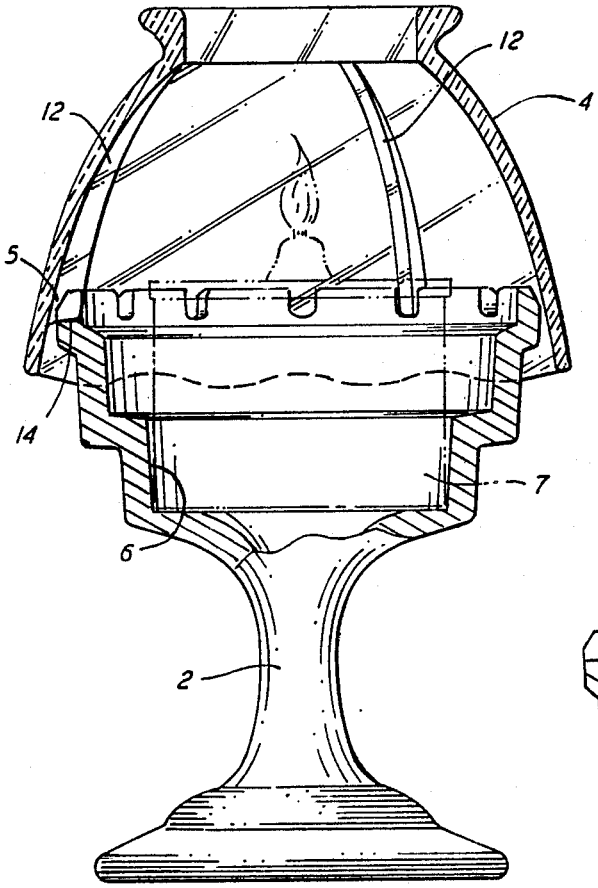
FIG. 1 is an elevation partially in cross-section of a pedestal and globe assembly according to the present invention.

Referring to FIG. 1 there is shown a typical table lamp of the restaurant/night club type consisting of a pedestal or base 2 and a globe or shade 4 each having a generally circular cross-section. Globe 4 generally is made of a light transmitting material such as glass that gives a pleasing and decorative appearance in combination with the pedestal. The pedestal base 2 has an internal receptacle portion 6 in which is placed a candle or other flame source 7. The flame source may be a candle or one of several types of self-contained liquid or gas type refillable or disposable fuel cells presently in wide use. The globe 4 acts as a shield for the flame source to prevent casual air movement from extinguishing the flame source, while at the same time, allowing sufficient ventilation through annular space 5 to support combustion.

Figure 2:
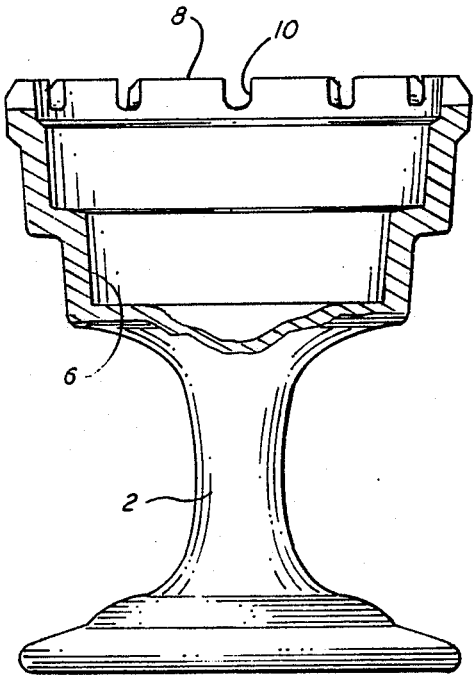
FIG. 2 is a partial cross-sectional view of the pedestal of FIG. 1.
Figure 3:
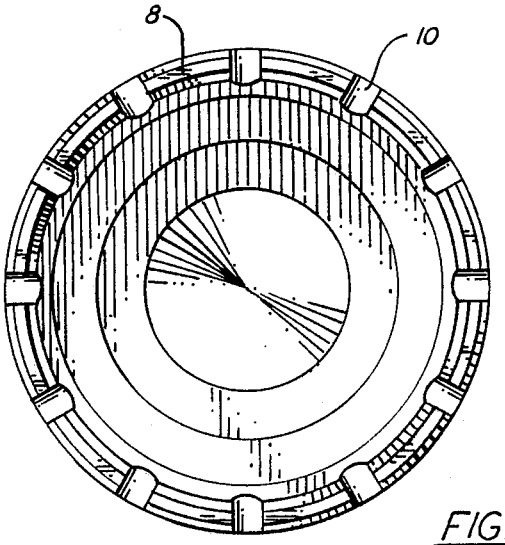
FIG. 3 is a plan view of the top of the pedestal of FIG. 2.

As may be seen in FIGS. 2 and 3 the pedestal has an upper annular surface or lip 8 on which prior art globes are seated. In the prior art the globes generally have had a number of inwardly projecting lugs molded on the inner surface. These lugs have had a horizontal flat section to engage the lip of the pedestal and usually a vertical section to help center the globe on the pedestal. As noted above, the globe easily slips off because this arrangement produces a very unstable assembly and results in easy accidental separation of the globe from the pedestal causing excessive breakage of the globes.

In FIG. 1 the globe 4 is shown as having three lugs 12 spaced at 120 degree intervals about the inside surface thereof. Each lug 12 has a horizontal flat portion 14 at its bottom edge, the three lugs' flat portion providing a horizontal flat section.

As may be seen in FIG. 2, the upper annular surface 8 of pedestal 2 has a series of slots 10 cut therein. The slots are cut vertically into the annular surface or lip 8 of the pedestal and are oriented on radials of the circular cross-section of the lip. In the embodiment shown, the slots 10 are spaced about the annular surface 8 at 30 degree intervals making a total of twelve (12). (See FIG. 3)

The dimensions of lugs 12 and slots 10 are chosen to provide a smooth slidable fit as the globe is installed on the pedestal and the lugs are engaged in the slots. The outer edge of annular surface 8 is chamferred at an angle of about 30 degrees. A globe with three lugs spaced 120 degrees apart can be engaged or dropped into the slots by rotation of no more than 30 degrees.

The lugs 12 are placed on the inner surface of globe 4 so that when they are bottomed out in slots 10 the globe is spaced above the base pedestal 2 an appropriate distance to form annular space 5 allowing further ventilation for burning of the flame source in recess 6. This three point mounting also assists in providing a level or non-rocking mounting of globe 4 on pedestal 2.

Slots 10 are cut deep enough to completely "capture" lugs 12 when the globe 4 is positioned on base 2. With at least three lugs 12 on the globe fully engaged in slots 10 of the pedestal the globe is effectively interlocked with the pedestal. No matter in what direction one attempts to knock the globe off at least two lugs are "gripped" by the sides of at least two slots 10 to hold the globe in place. This arrangement precludes dislodging by a more or less horizontal force, yet provides easy vertical movement when dropping into place or deliberately lifting straight up to remove. Reasonable tolerance in the slot and lug dimensions must be maintained for easy on and off mounting and removal of the globes and to provide for variance in manufactured parts. Excessive tolerances will defeat the purpose of the slots and the globe will not be as securely interlocked with the pedestal.

In a typical pedestal of about 4" diameter the three lugs 12 generally are 3/16 of an inch in thickness and have a mating surface 14 about ¼ inch in length on the radial dimension. Slots 10 are approximately ¼ inch wide by ¼ inch deep and extend through the entire edge or lip of the pedestal. Other sizes, shapes, and configurations of globe lugs and slots in bases and pedestals will require different sets of dimensions.

It has thus been found that by interlocking the globe 4 with the pedestal 2 by engaging at least three lugs 12 in the slots 10 it is much more difficult to accidentally dislodge the globe from the pedestal compared with the prior practice of resting the lugs 12 on the annular surface 8. The lamps may now be quickly and casually moved from table to table with greatly reduced incidence of accidental dislodging and breakage. The globe, however, still may be easily lifted upand removed to light the flame source and with slots 10 four times the number lugs 12 a minimum twisting is required to fully interlock globe 4 in pedestal 2 when replacing.

Also by providing twelve slots not only has the ease of installation been maintained and security improved, but globes with 3, 4, 6, or 12 equally spaced lugs or 9 in groups of 3 may be used on the pedestal of the present invention. Similarly, other multiples of lugs may be used without departing from the scope of the invention.

While the invention has been described in the specification and illustrated in the drawings with reference to a preferred embodiment it will be understood by those skilled in the art that various changes may be made and equivalents may be substituted for elements of the invention without departing from the scope of the claims.

What is claimed is:

1. A lamp of the type having a flame source and a shield to prevent extinguishing of the source comprising a pedestal having a body portion and a central receptacle portion containing a flame source, a generally horizontal top surface on an upper edge of the body portion of said pedestal, a plurality of radial slots that pass downwardly through said horizontal top surface of said body, each to the same depth, each slot having opposed side walls and a bottom wall contained in said body, shield means mounted on said pedestal having at least three radial inwardly extending lugs mounted on an interior surface of said shield, and each of said lugs having opposed side walls and a bottom wall and being slidably received in a slot so that the bottom wall of the lug rests upon the bottom wall of the receiving slot and the side walls of said lugs extend upwardly beyond the top surface of said body whereby at least two of said lugs are gripped by the side walls of their respective receiving slot when said shield means is moved laterally on said pedestal.

2. A device as described in claim 1 wherein said plurality of slots are a multiple of the number of lugs on said shield means, extend radially entirely through the upper edge of the body portion and are at least as deep as they are wide.

3. A device as described in claim 2 further defined by said plurality of slots being arranged at uniform intervals about the top of the body portion of said pedestal.

4. A device as described in claim 1 wherein said shield means comprises a globe of light transmitting material, said slots number at least as many as there are lugs on said globe and said slots are at least as deep as said lugs are wide to capture said lugs in the radial slots in said body top surface when said globe is seated on said pedestal.

5. The invention of claim 1 wherein said lugs are dimensioned to fit said slots in smooth, slidable engagement, as said shield means is operatively installed on said pedestal to prevent rotational and lateral movement of said shield means when said shield means is seated upon said pedestal.

6. The invention of claim 1 wherein said shield means comprises a globe having at least three inwardly extending lugs and said pedestal has twelve equally spaced vertical slots cut in the body top support surface so that the globe may be seated on said body top support surface and the lugs engaged in said slots by no more than thirty degrees rotation of said globe.

7. The invention of claim 6 wherein said lugs are positioned on said globe so as to hold the globe away from the upper lip of said pedestal to provide ventilation for said flame source.

8. The invention of claim 1 further characterized by said pedestal being of circular cross section, said flame source being a liquid fuel disposable fuel cell and burner, and said shield means being a glass globe having at least three lugs, and said pedestal having twelve (12) slots cut therein to selectively receive the lugs of said globe.

9. The invention of claim 1 further characterized by said pedestal being of circular cross section, said flame source being a liquid fuel refillable fuel cell and burner, said shield means being a glass globe having at least three lugs, and said pedestal having twelve (12) slots, cut therein to selectively receive the lugs of said globe.

10. The invention of claim 1 further characterized by said pedestal being of circular cross section, said flame source being a candle, said shield means being a glass globe having at least three lugs, and said pedestal having twelve (12) slots cut therein to selectively receive the lugs of said globe.

* * * * *